United States Patent [19]

Vinicio

[11] Patent Number: 4,622,909

[45] Date of Patent: Nov. 18, 1986

[54] METHOD AND APPARATUS FOR APPLYING A GUSSET TO MANUFACTURED ARTICLES

[75] Inventor: Gazzarrini Vinicio, Florence, Italy

[73] Assignee: Solis S.r.l., Florence, Italy

[21] Appl. No.: 55,261

[22] Filed: Jul. 6, 1979

[30] Foreign Application Priority Data

Jul. 7, 1978 [IT] Italy ..... 9529 A/78

[51] Int. Cl.[4] ..... D05B 21/00

[52] U.S. Cl. ..... 112/262.3; 112/121.15

[58] Field of Search ..... 112/121.15, 262.3, 262.1, 112/121.11, 121.12, 121.29, 63; 223/43; 2/409

[56] References Cited

FOREIGN PATENT DOCUMENTS 462086 6/1978 Spain ..... 112/121.15

*Primary Examiner*—H. Hampton Hunter

*Attorney, Agent, or Firm*—McAulay, Fields, Fisher, Goldstein & Nissen

[57] ABSTRACT

A method and apparatus for applying a gusset to manufactured articles, and especially articles such as panty hose and other similar products, involve the use of a funnel-like element having an upper edge which has a shape and dimension corresponding to the gusset to be applied and includes projecting acicular teeth. The product to which the gusset is to be applied is supported over the mouth of the funnel-like element by the teeth. The gusset is applied and clamped into place and a sewing machine secures the gusset to the finished product. When the operation is completed, the teeth can be retracted and the finished product drawn down through the funnel-like element by a pneumatic transfer device.

12 Claims, 5 Drawing Figures

METHOD AND APPARATUS FOR APPLYING A GUSSET TO MANUFACTURED ARTICLES

BACKGROUND OF THE INVENTION

The present invention is concerned with a method and apparatus for applying a gusset to manufactured articles and especially to panty hose.

A prior method of making panty hose involves first manufacturing the panty hose and thereafter applying a reinforcing panel or gusset in order to extend the useful life of the panty hose. The application of the gusset has been by hand with the aid of a cutting and sewing machine.

As can readily be realized, applying the gusset using manual methods is time consuming and therefore costly in terms of labor and reduced production. In addition, uniformity in the finished products if difficult to maintain and, in practice, is usually low.

It is therefore an object of this invention to provide a method and apparatus for applying a gusset to manufactured articles in general, and in particular to such difficultly handled products as panty hose and other similar products.

BRIEF DESCRIPTION OF THE INVENTION

Briefly, the method of applying a gusset to a manufactured article, and especially to panty hose or the like, according to the present invention includes the following steps: manually stretching and fixing the manufactured article to a funnel-like device having a form substantially conforming to the shape of the gusset to be applied; applying the gusset to the product; holding the gusset steady against the stretched product; sewing the gusset to the product; and removing the article from the funnel-like support by pneumatic means downwardly through the funnel for delivery elsewhere.

The device for accomplishing the invention method, preferably comprises a plurality of product support stations and one or two sewing machine stations. The product support stations are mounted on a rotable hub for sequential movement to the sewing machine stations. Each of the support stations includes a funnel-like support having an open mouth generally in the shape of the gusset to be applied mounted on an arm radially extending from the hub. It is over this open mouth that the panty hose or other item is stretched and held for subsequent processing. A gusset is then applied and a clamping device preferably provided to hold it in place until it is rotated in turn to the sewing machine or machines where the gusset is secured to the panty hose. Two sewing machines are preferably used in order to simplify the support device by eliminating the need to reverse the support mechanism to permit sewing of both halves of the gusset.

In the preferred embodiment, the funnel-like holding device includes a row of retractable acicular teeth to hold the panty hose in place. When the gusset has been secured to the panty hose, the teeth are retracted and the panty hose drawn downwardly into the funnel-like support by a vacuum transfer device to be discharged from the station for use elsewhere.

DESCRIPTION OF THE PREFERRED EMBODIMENT

Figure 1:
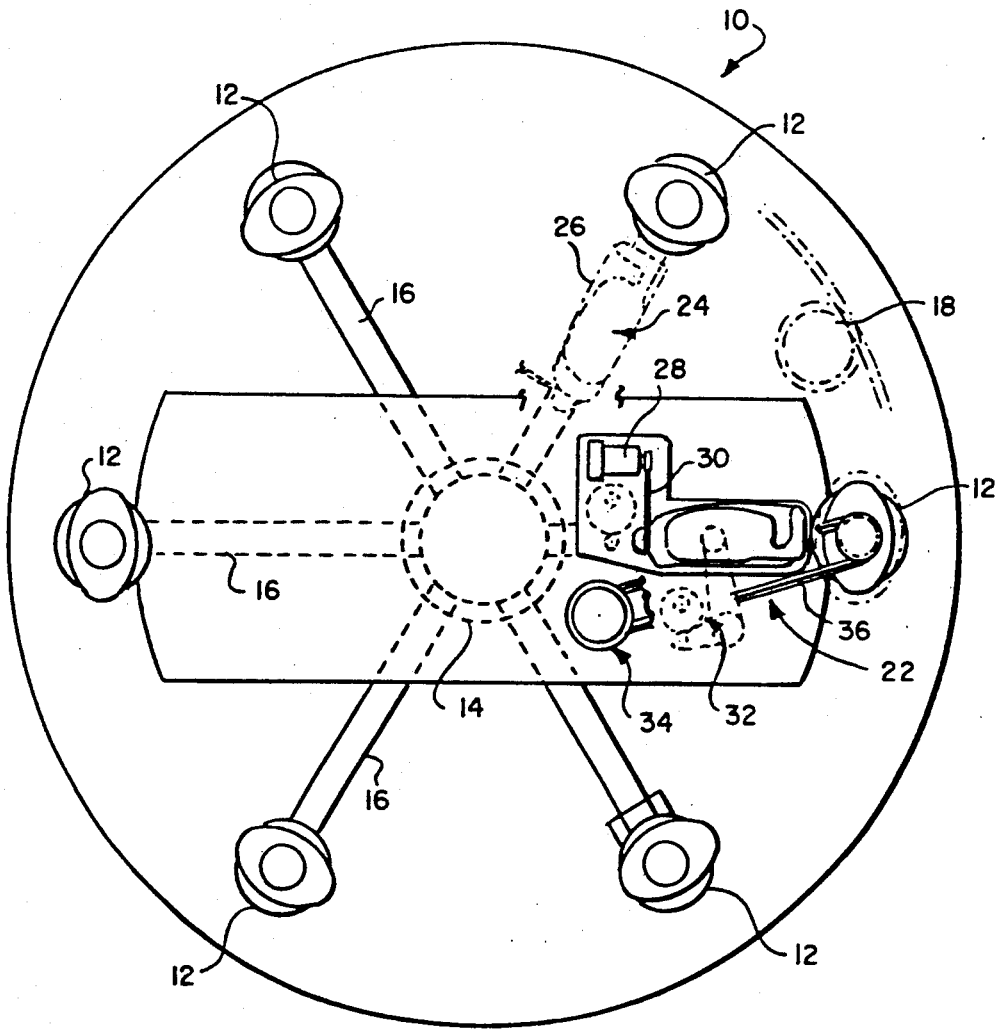
FIG. 1 is a simplified plan view of a manufacturing device according to the present invention, showing the interrelationship among the various major elements thereof.

The preferred embodiment of the present invention is an apparatus 10 in a carousel-like form for continuous sequential application of a gusset to a manufactured article, having a plurality of stations 12 secured to a rotating central hub 14 by outwardly extending support arms 16. As illustrated in FIG. 1, hub 14 is rotatably driven by motor driven gear 18 and gear 20, thereby carrying stations 12 around a generally circular path. Sewing devices 22 and 24 are disposed along the path of movement of the stations 12 in order to secure the gusset to the product as required by the present invention method. Details of sewing and cutting device 24 have been left out of the drawings for simplicity, but are generally the same as for the device 22. Details of construction for these devices 22, 24 are generally well-known and include a sewing machine 26 powered by a sewing machine motor 28 through drive belt 30. A cam and lever mechanism 32 is preferably used to move the sewing machine 26 back and forth into alignment with the gusset to be sewn, as required. If it is desired to use only one sewing device 22, it is convenient for the operation of the sewing machine 26, to provide a rotating drive 34 to rotate station 12 about its central axis through a drive belt 36 to allow convenient sewing of the complete seam around the gusset once it is applied to the product. The preferred embodiment utilizes two separate sewing devices 22, 24.

Figure 2:
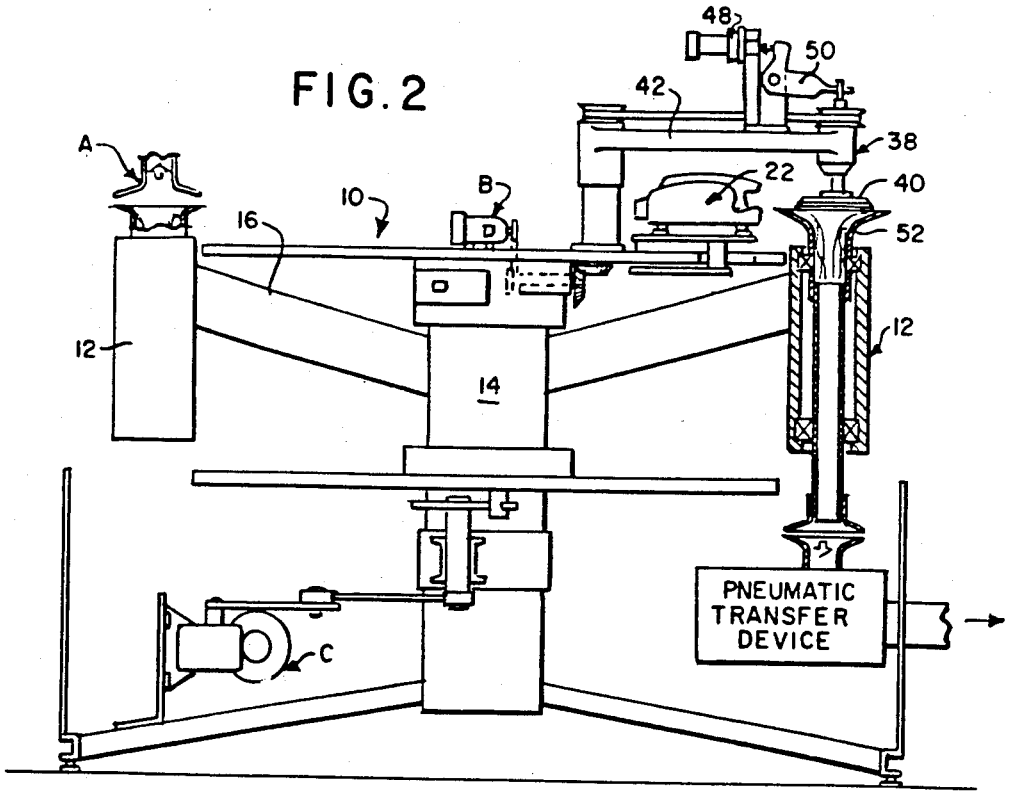
FIG. 2 is an elevational view partially in section of the device of FIG. 1 showing details of construction for the funnel-shaped support device.

With reference to FIG. 2, a gusset clamping device 38 is shown in place over station 12 located near sewing device 22. The working part of the gusset clamping device 38 is a plate 40 which is carried over station 12 by clamp arm 42.

A simple pneumatic cylinder device 48 can be used to move the plate 40 into and out of engagement with station 12 through a bell crank 50. Equivalent drive structures and linkages can obviously be substituted as required by the devices employed and the design of the equipment.

Figure 3:
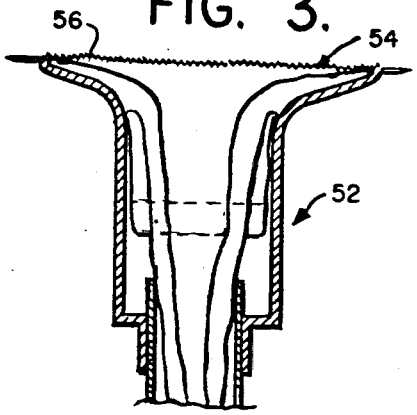
FIG. 3 is a more detailed enlarged vertical sectional view of the funnel support device.
Figure 5:
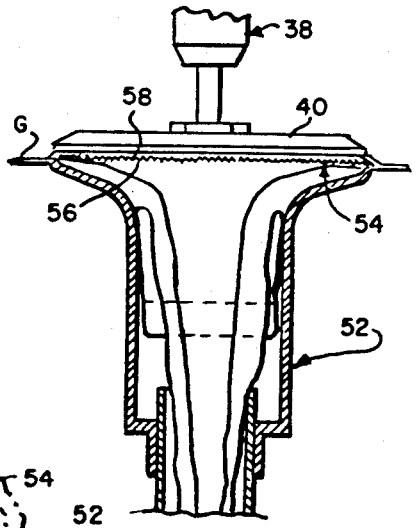
FIG. 5 is a view similar to FIG. 3, but showing the gusset clamping the device in place thereover.
Figure 4:
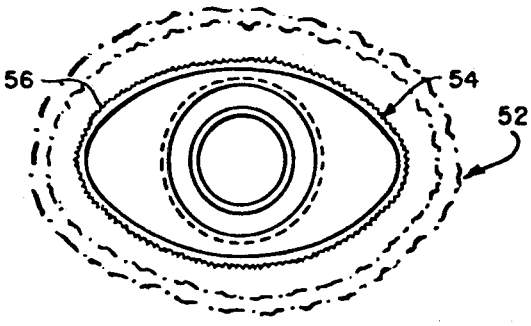
FIG. 4 is a plan view thereof.

An important element of the invention is the funnel-shaped support device 52 shown in detail in FIGS. 3, 4 and 5.

The enlarged mouth portion of the funnel-shaped support device 52 preferably faces upwardly and includes a row of acicular teeth 56 around the edge therof. The open mouth portion 54 is generally in the shape and size slighly smaller than the gusset to be applied. The product to which the gusset is to be applied is stretched over the open mouth portion 54 and held by the teeth 56. With reference to FIG. 5, plate 40 of gusset clamping device 38, has a size and shape to match the open mouth portion 54. After the material has been stretched over the open mouth portion 54, a gusset G is applied and plate 40 lowered into abutment with the open mouth portion 54. Plate 40, as shown in FIG. 5, may also be provided with a row of acicular teeth 58 to match the teeth 56 on the support device 52.

With reference to FIG. 2, the clamped together product and gusset are rotated into position near cutting and sewing device 22 where the gusset and product are sewn together. As noted above with respect to FIG. 1, a second sewing device 24 may be provided at a subsequent position whereby both sides of the gusset can be conveniently sewn. This eliminates the need for sewing device 22 to be manipulated to pass around gusset clamping device 38, as can be seen in FIGd. 2, or, alternatively, the need to provide a rotating device 34 to rotate station 12 to gain access to both sides of the gusset for sewing device 22.

As illustrated in FIG. 2, a pneumatic transfer device is preferably disposed at the bottom of station 12 when it is near sewing device 22, to draw or "suck" the finished product from the mouth 54 of the support device 52, after the sewing step has been completed and the product has been released by removal of clamping device 38. The pneumatic transport device can be any usual device of this type modified to interconnect with the bottom of the support device 52. Acicular teeth 56 may be retractable with respect to the upper edge of the open mouth portion 54 thereby to facilitate freeing the product for movement by the pneumatic transport device.

The preferred embodiment device incorporates several additional features which are generally shown in FIG. 2:

Schematically shown at A is a panty hose reverse and alternate transport arrangement. This is basically the same type of transport device used to draw panty hose downwardly through the support, but is disposed over the support.

The motor and associated linkage devices B are to rotate the support device 52 during the sewing operation, through plate 40.

The motor and associated linkage C is to rotate one half turn in stepwise fashion, the hub, between sewing stations when the sewing is accomplished using two sewing stations with usual sewing and cutting machines for stockings.

OPERATION OF THE DEVICE

The preferred method of operating a device according to the present invention includes manually stretching and fixing the manufactured article to a funnel support device which is rotable to a sewing station. A gusset G of proper size is laid over the stretched article and the clamp plate 40 pressed down to hold the article. If two sewing devices are used, the product must be moved to the second sewing device 24 to have sewn the portion of the gusset not reached by the first sewing device 22.

Finally, the manufactured device is released from the funnel support device and drawn into the center of the funnel support device by a partial vacuum applied from below. This delivers the article through a pneumatic device as required outside of the funnel support.

What is claimed is:

1. A method for automatically applying a gusset to a manufactured pantyhose article comprising the steps of:

manually positioning and clamping the manufactured article over a funnel-shaped support device having an open mouth substantially the same size as the gusset to be applied;

moving the support device to a sewing station;

placing the gusset onto a gusset clamping device;

lowering the gusset clamping device with the gusset held thereto over said mouth portion into abutment therewith and clamping the gusset and manufactured article together;

sewing the gusset to the article;

unclamping said gusset; and pneumatically removing the article with the gusset sewn thereto from the funnel-shaped support by applying a vacuum to the bottom of the funnel-shaped support thereby to draw the article downwardly therethrough.

2. In the method of claim 1 using a plurality of funnel-shaped support devices mounted to a rotatable support to move the devices sequentially to a sewing station, the steps of sequentially moving the funnel-shaped support devices to the sewing station.

3. A method for applying a pre-cut gusset to a manufactured pantyhose article having an opening, comprising the steps of:

manually positioning the manufactured article over a support device having an open mouth with the opening surrounding the open mouth;

moving the support device to a sewing station;

positioning the gusset onto a clamping device having a size and shape to match the open mouth;

moving said clamping device with the gusset thereon to position the gusset onto the article;

sewing the gusset to the article; and removing the article with the gusset sewn thereto from the support.

4. A method for applying a gusset to a pantyhose article having a crotch opening comprising the steps of:

manually positioning the crotch opening of the pantyhose article over a support device including gripper means and having an open mouth;

moving the support device to a sewing station;

positioning the gusset onto the article over the crotch opening;

sewing the gusset to the article; and removing the article with the gusset sewn thereto from the support.

5. A method for applying a gusset to a pantyhose having a crotch opening, comprising the steps of:

positioning the pantyhose over a support device including gripper means and having an open mouth with the crotch opening stretched over the open mouth;

moving the support device with the manufactured article to a sewing station;

positioning the gusset onto the pantyhose;

sewing the gusset to the pantyhose; and removing the pantyhose with the gusset sewn thereto from the support device.

6. The method as claimed in claim 5, including mechanically seaming the gusset and the pantyhose by a seaming machine whose position relative to the axis of rotation is variable radially of said axis and during rotation to enable said machine to follow the gusset periphery.

7. A method as claimed in claim 5, including drawing the pantyhose over the support with the opening in the pantyhose adjacent one end of the support for receiving the gusset, and presenting the gusset to the pantyhose and supporting the gusset proximate to one end of the support with the open mouth and the periphery of the gusset overlapping the periphery of the opening.

8. The method as claimed in claim 5, including rotating the gusset and the pantyhose relative to a single seaming machine about an axis passing through the gusset to secure the gusset to the garment by a single continuous seam.

9. A method as claimed in claim 5, wherein said support device comprises a pneumatic transfer device for drawing the pantyhose into the support device, and said gripper means also including teeth relative to said open mouth for gripping the gusset, the pantyhose being moved towards a station having a gusset clamping device to clamp the gusset to the periphery of the gripped pantyhose.

10. A method as claimed in claim 5, including rotating the pantyhose and the gusset together by rotating the support about its longitudinal axis.

11. A method as claimed in claim 5, wherein the gusset periphery and the pantyhose are maintained in a desired attitude for seaming thereof by the gripper means and acicular teeth.

12. A garment having a gusset seamed thereto according to the method as claimed in claim 5.

* * * * *